US006008769A

United States Patent [19]

Palmiter et al.

[11] Patent Number: 6,008,769

[45] Date of Patent: Dec. 28, 1999

[54] ALIGNMENT CONTROL DEVICE

[75] Inventors: Paul S. Palmiter, Silver Spring; Lawrence H. Westerlund, Rockville, both of Md.

[73] Assignee: Comsat Corporation, Bethesda, Md.

[21] Appl. No.: 08/126,439

[22] Filed: Sep. 24, 1993

Related U.S. Application Data

[63] Continuation of application No. 07/687,660, Apr. 19, 1991, abandoned.

[51] Int. Cl.[6] ..... H01Q 3/10

[52] U.S. Cl. ..... 343/766; 343/882

[58] Field of Search ..... 343/882, 765, 343/766; H01Q 3/10

[56] References Cited

U.S. PATENT DOCUMENTS 4,126,865 11/1978 Longhurst et al. ..... 343/766

4,628,323 12/1986 Crean ..... 343/882

4,692,771 9/1987 Rothbarth et al. ..... 343/766

5,077,561 12/1991 Gorton et al. ..... 343/882

*Primary Examiner*—Michael C. Wimer

*Attorney, Agent, or Firm*—Sughrue, Mion, Zinn, Macpeak & Seas, PLLC

[57] ABSTRACT

A tracking device comprises a cam-driven actuator arm by which the declination of an earth station dish is caused to vertically oscillate with a sidereal day cycle. In a second embodiment, the tracker comprises a constant velocity joint interposed between the satellite dish and the elevation frame of the antenna mounting structure. The rotation of the constant velocity joint over a sidereal day cycle will result in tracking of the figure eight path.

7 Claims, 6 Drawing Sheets

ALIGNMENT CONTROL DEVICE

This is a Continuation of Application Ser. No. 07/687,600 filed Apr. 19, 1991, abandoned.

BACKGROUND OF THE INVENTION

The present invention is directed to a device for maintaining alignment between two rotating coordinate systems. While it has broader utility, it will be described herein in the context of satellite communications, and more particularly in the context of an improved technique for the tracking of a geosynchronous satellite by a ground antenna.

Most communication satellites are intended to be "geostationary", i.e., they orbit the earth at the same angular velocity as the spin of the earth so that they remain substantially stationary with respect to any given point on the earth. This allows the satellites to be used on a 24 hour per day basis.

However, if the orbital path of a satellite is even slightly inclined with respect to the equator, the satellite will appear from a vantage point on earth to move in a figure eight or oriented perpendicular to the geosynchronous arc with a sinusoidal period of 24 hours. An earth station antenna communicating with the satellite can be oriented at the center of the figure eight path, but will nonetheless experience signal strength variations over the course of a sidereal day.

There is a need, then, for an improved tracking technique which will accommodate the figure eight path of a geosynchronous satellite to obtain improved signal strength for a given earth station antenna size, and a further need for such a technique which can be implemented with low cost and high reliability.

On a more generalized level, it will be appreciated that there is a need for a technique for maintaining alignment between two coordinate systems which are rotating at the same rate but at some arbitrary angle with respect to one another.

SUMMARY OF THE INVENTION

It is an object of the present invention to address the alignment problem discussed above. This and other objects are achieved according to the present invention by a device which, in a first embodiment, comprises a simple cam-driven actuator arm by which the declination of an earth station dish is caused to vertically oscillate with a sidereal day cycle. In a second embodiment, well-suited to use in satellite tracking but adaptable for other applications as well, the device comprises a constant velocity joint or other suitable coupling member interposed between the satellite dish and the elevation frame of the antenna mounting structure. The rotation of the coupling member over a sidereal day cycle will result in tracking of the figure eight path in both declination and hour angle.

BRIEF DESCRIPTION OF THE DRAWINGS

The present invention will be more clearly understood from the following description in conjunction with the accompanying drawings, wherein.

DETAILED DESCRIPTION OF THE PREFERRED EMBODIMENTS

Figure 1:
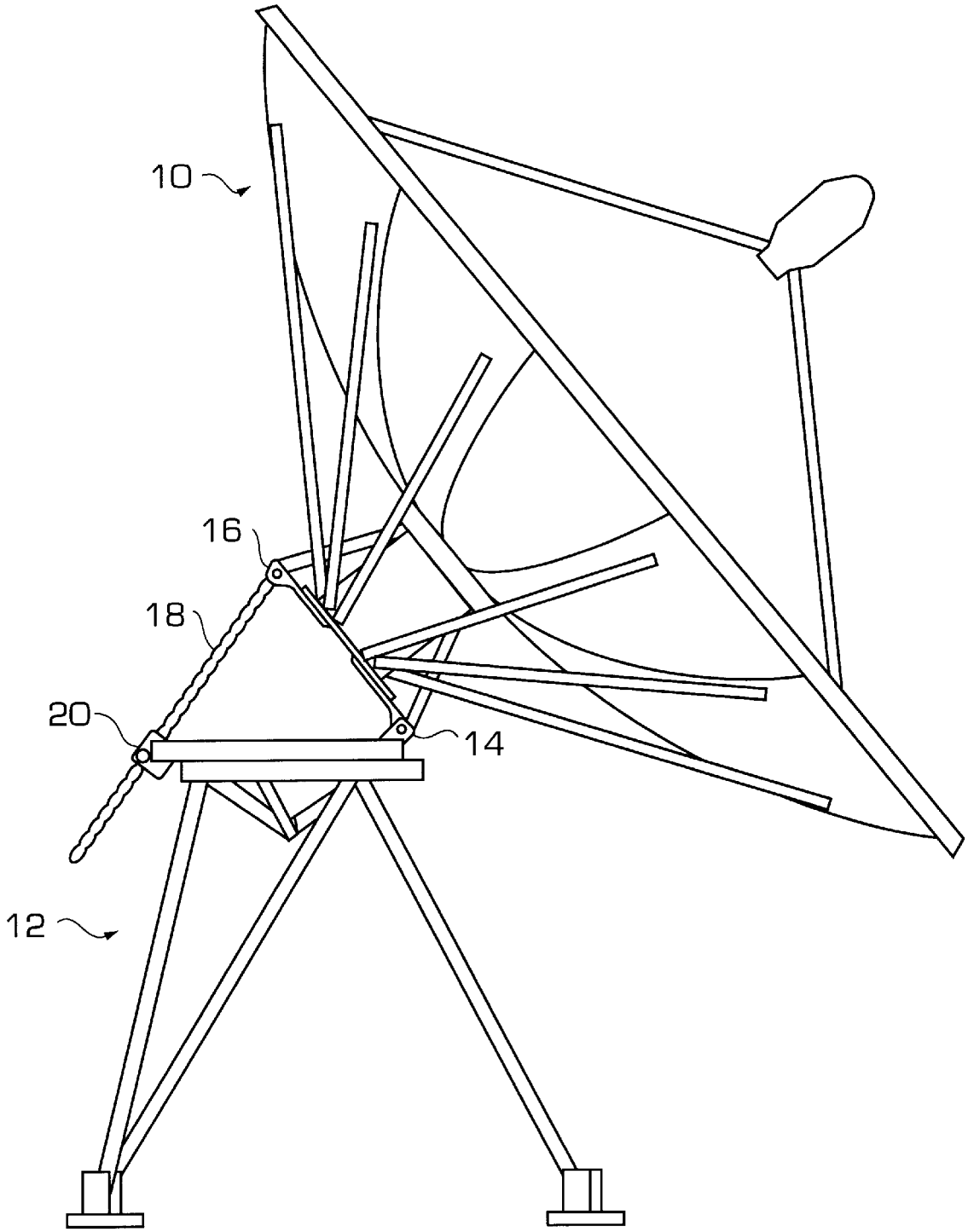
FIG. 1 PRIOR ART
FIG. 1 is an illustration of a conventional antenna installation.

FIG. 1 is an illustration of a conventional antenna installation, with the antenna dish 10 mounted to an A-frame assembly 12 via pivot points 14 and 16 and elevation arm 18. The declination of the antenna is adjusted by pivoting the dish 10 about pivot point 14 as the elevation arm 18 slides longitudinally through the clamping mechanism 20. When the desired declination is reached, the position of the elevation arm 18 is fixed by the clamping mechanism 20.

Figure 2:
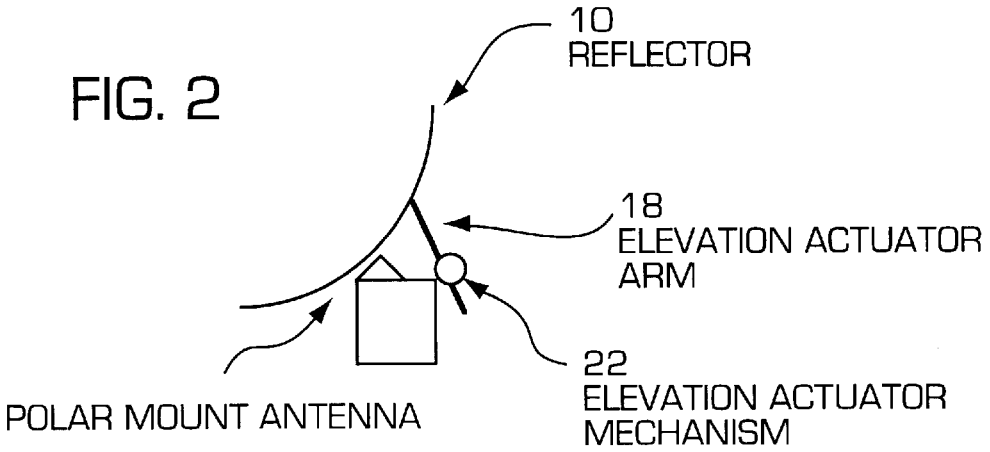
FIG. 2 is a schematic illustration of a tracking apparatus according to a first embodiment of the invention.
Figure 3:
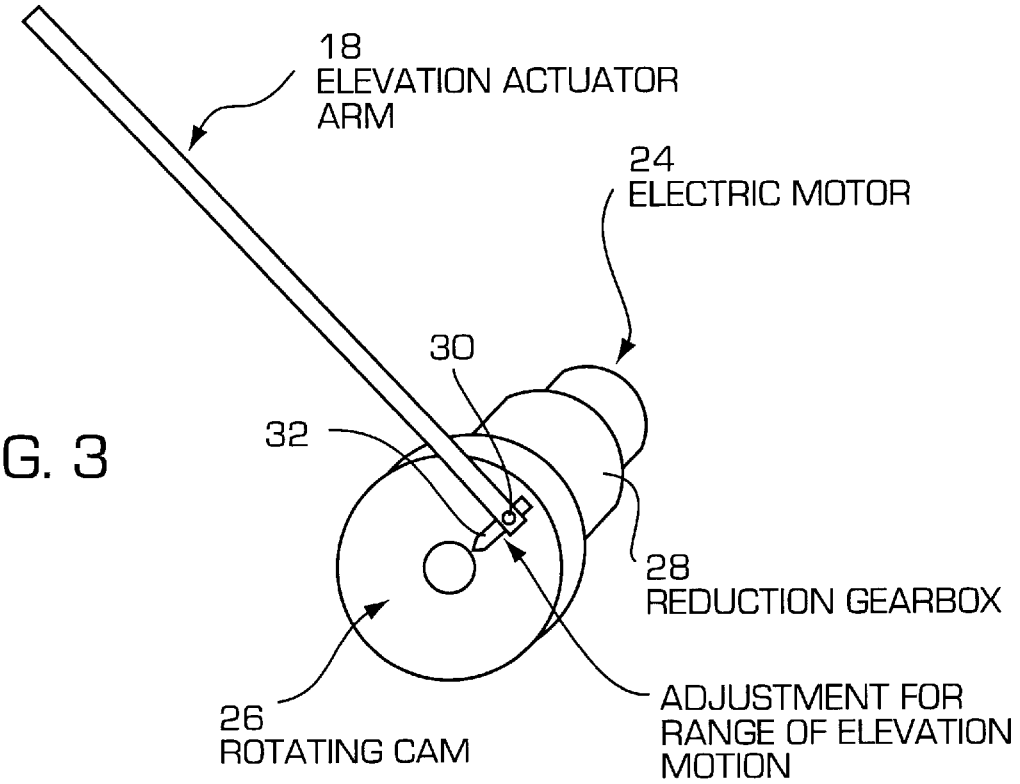
FIG. 3 is a more detailed diagram of essential portions of the embodiment of FIG. 2.

The first, and simplest, embodiment of the invention can be understood with reference to FIGS. 2 and 3. In this embodiment, the clamping mechanism 20 of FIG. 1 is simply replaced by an elevation actuator mechanism 22 shown in more detail in FIG. 3. The actuator mechanism comprises an electric motor 24 driving a rotating cam 26 through a reduction gear box 28. The elevation arm 18 is coupled to an end face of the cam 26 via a pin 30. The elevation arm 18 is pivotable about the pin 30, but the pin 30 is in a fixed position within the slot 32. By fixing the position of the pin 30 within the slot 32, the user can adjust the radius of the path defined by the pin 30 during rotation of the cam 26, thereby adjusting the magnitude of the declination oscillation imparted to the antenna dish.

The embodiment illustrated in FIGS. 2 and 3 is designed on the theory that, with a sufficiently small ground antenna and a sufficiently small satellite inclination, the width of the figure eight path can be ignored. In this case, a ground antenna with a polar mount need only move the declination axis in a sinusoidal fashion in order to track an ELS satellite. The electric motor 24, after speed reduction in gear box 28, causes the cam 26 to rotate through one revolution per sidereal day. This rotation of one revolution per sidereal day will impart an oscillation to the declination of the antenna, the oscillation having a period of one sidereal day. As used herein and in the appended claims, the term "periodic oscillation" refers to an oscillating motion which cycles back and forth with a regular and repeating period, the period of oscillation being one sidereal day in the example described herein. This periodic oscillation is imparted to the antenna reflector automatically in that it is done without manual operation during any particular oscillation cycle, i.e., it is accomplished by a power-driven mechanism which defines the period of the oscillation cycle. To compensate for the growth of the satellite inclination, the range of declination motion must be occasionally increased. This is accomplished by periodically moving the pin 30 to a larger radius position, with this adjustment being performed either manually or automatically by a simple mechanism. For example, a screw could be housed within the slot 32 and extending in the radial direction of the cam 26. The elevation arm could then be coupled to this screw via a suitable threaded coupling member, such that rotation of the screw would change the radial position of the coupling member. The end of the screw could then extend out through the outer peripheral surface of the cam 26 and have a star wheel mounted thereon. As the cam rotates through one revolution per day, the star wheel would be turned by engagement with, e.g., a fixed pin, thereby rotating the screw and adjusting the radial position of the coupling member by an appropriate amount each day. Other arrangements for automatic adjustment will also be readily apparent.

A second embodiment of the invention will now be described with reference to FIGS. 4–9. This second embodiment, at a slight increase in complexity, varies both the hour angle and declination of the antenna in order to more faithfully track the figure eight pattern of the satellite. This embodiment is also more widely applicable to any system where it is necessary to maintain an axis in one coordinate system in alignment with a particular point in another coordinate system as the two coordinate systems rotate at the same rate but at an arbitrary angle with respect to one another.

Figure 4:
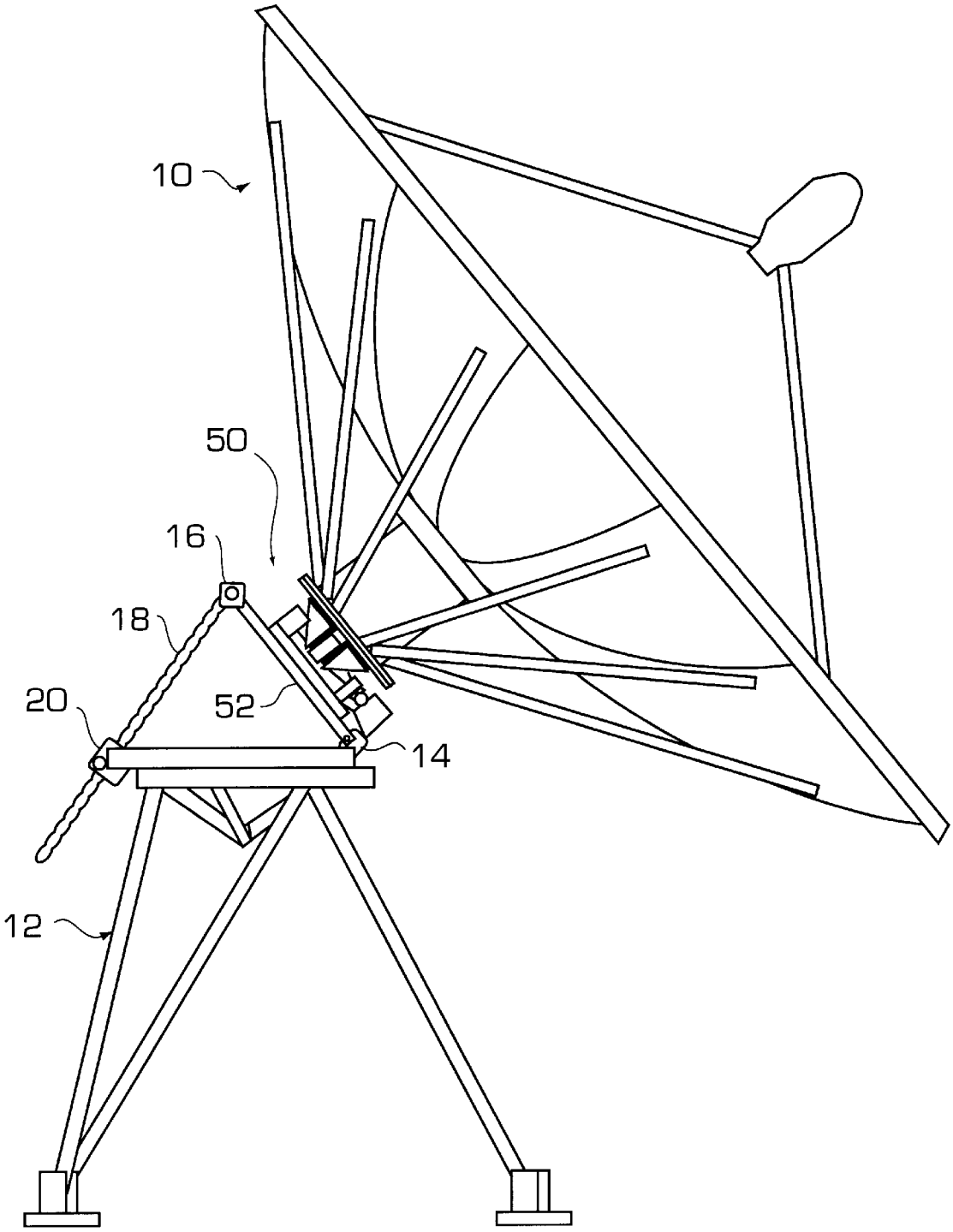
FIG. 4 is an illustration of an antenna installation incorporating a tracking apparatus according to a second embodiment of the invention.

Turning first to FIG. 4, the tracker assembly according to the second embodiment of the invention is generally shown at 50. This assembly is physically located between the elevation arm 18 and the antenna dish 10, as opposed to the first embodiment which was located between the elevation arm 18 and the A-frame assembly 12 in place of the clamper mechanism 20. According to this second embodiment, the declination of the antenna is set to a nominal value through adjustment of the elevation arm 18 in a conventional manner, and the tracker assembly varies the declination and hour angle of the antenna reflector without further movement of the elevation arm 18.

Figure 5:
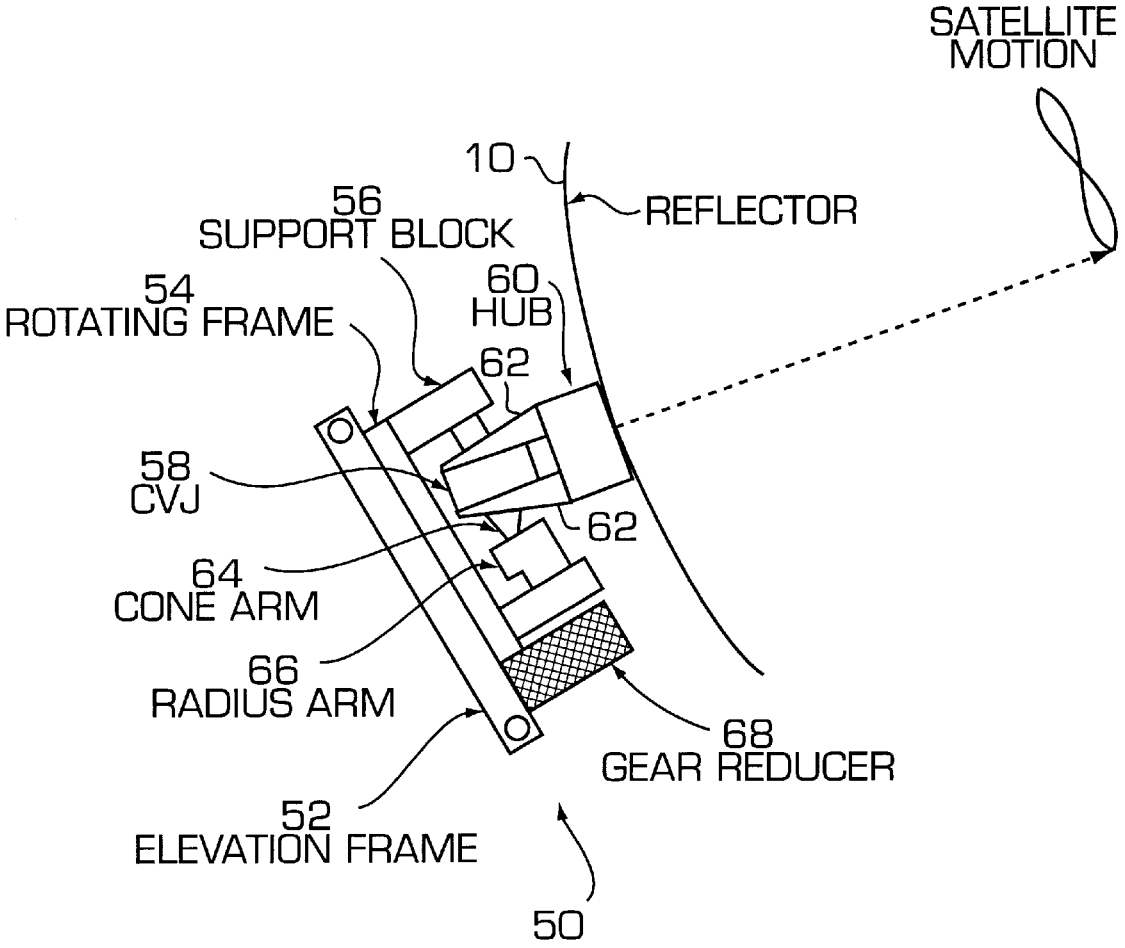
FIG. 5 is a more detailed illustration of essential portions of the second embodiment, with the tracker at its lowest point of travel.

FIG. 5 illustrates the essential components of the tracker mechanism 50. The diagram shows the configuration of the tracker at the lowest point of travel, when the satellite is at the southernmost point of the orbit. An elevation frame 52 serves as the base of the tracker unit and attaches to the A-frame 12 at pivot point 14 and to the elevation arm 18 at pivot point 16, all as shown in FIG. 4. A rotating frame 54 carries all of the active components of the tracker mechanism and is rotatable around the elevation frame 50 about the boresight (pointing) axis of the antenna. The ability to rotate the rotating frame 54 allows the tracking axis to match the orientation of the satellite's motion at any location on the surface of the earth.

On the rotating frame 54, a support block 56 fixes the center of a constant velocity joint (CVJ) 58. In this application, the CVJ is not used for power transmission, its customary role, but rather as a spherical bearing to allow freedom of motion for the antenna. The outside of the CVJ attaches to the antenna hub 60 via triangular brackets 62, and a cone arm 64 is rigidly attached to the antenna hub brackets 62 and connects the CVJ to a radius arm 66.

An electric motor (not shown) drives a gear reducer 68 to rotate the radius arm 66 through a circle once per day. The axis of rotation of the radius arm is along a line from the center of the CVJ to the center of the output shaft of the gear reducer 68.

The only moving parts in the assembly are the gear reducer 68, radius arm 66 and the CVJ/cone arm combination. The cone arm 64 is so named because its motion is in the shape of a cone. The radius arm 66 pivotally captures the end of the cone arm 64 and turns it in a circle (referred to as the "drive circle") once per day. The circle is the base of the cone. The center of the CVJ is held fixed by the support block 56, and represents the apex of the cone. The CVJ 58 acts as a spherical bearing, free to move in rotation in any axis, but held fixed in translation. The center line of the cone arm is always at right angles to the antenna boresight or pointing axis, and the polarization axis of the antenna is in line with the axis of the cone arm 64. The resulting motion of the tracker produces three axes of antenna motion exactly matching the motion of the satellite.

As was the case with the embodiment of FIG. 1, the radial position of the coupling of the cone arm 64 to the radius arm 66 is adjustable, either manually or automatically with an arrangement similar to that described above for the first embodiment.

Figure 6:
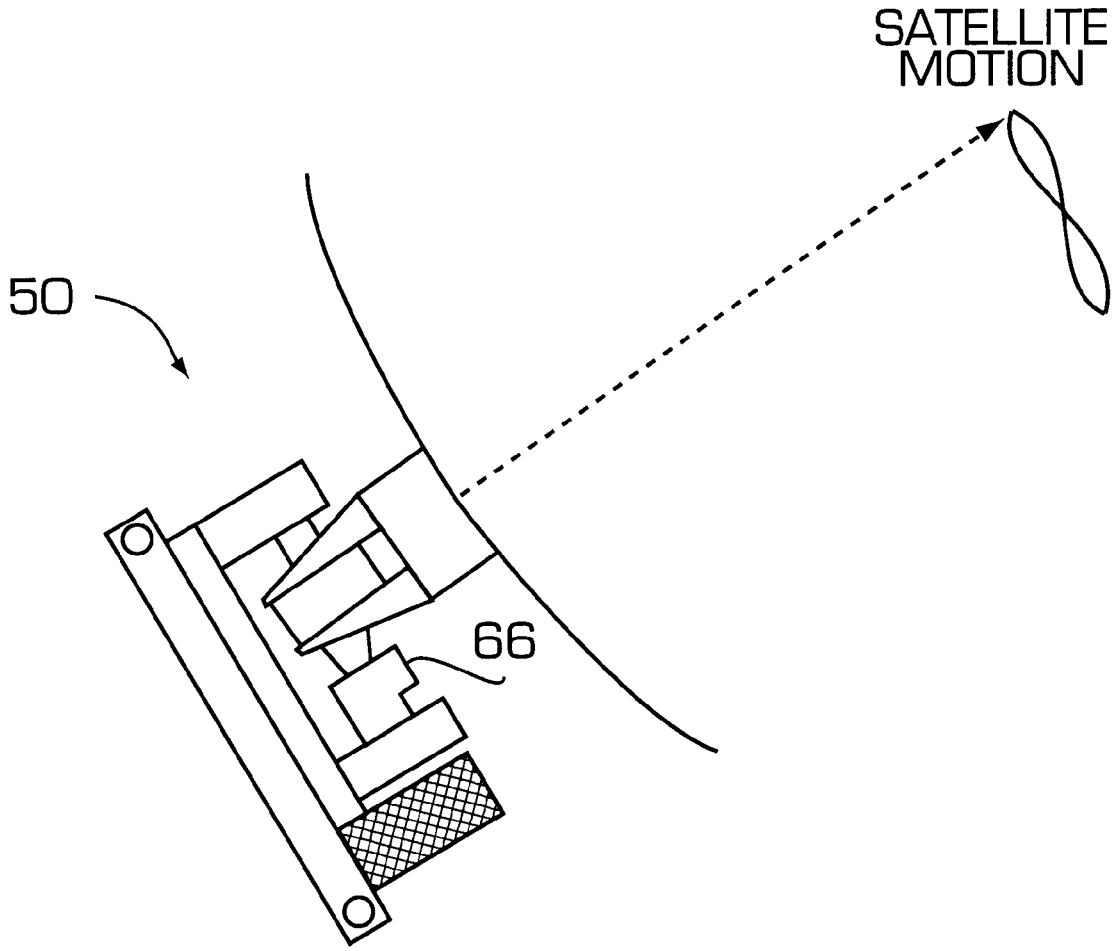
FIG. 6 is an illustration similar to FIG. 5 but with the tracker at its highest point of travel.

FIG. 6 illustrates the tracker 12 hours after the position shown in FIG. 5, at the highest peak of travel. The radius arm 66 has rotated 180° from the position shown in FIG. 5.

Figure 7:
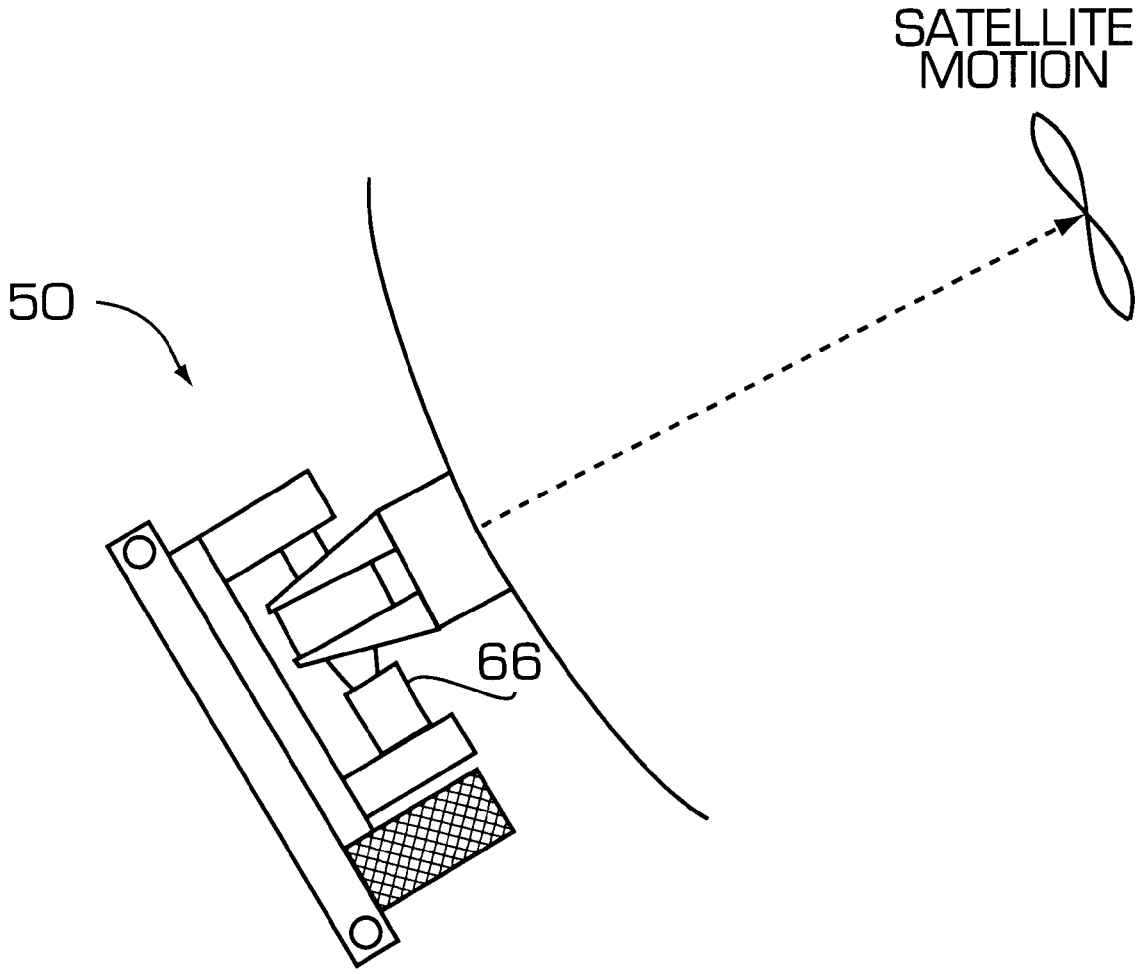
FIG. 7 is an illustration similar to FIG. 5 but with the tracker at its center position.

FIG. 7 shows the tracker in the nodal or center of box position, where the radius arm 66 has rotated 90° with respect to the positions in either of FIGS. 5 or 6. This is the position corresponding to the satellite's crossing of the equatorial plain, and the antenna pointing vector is at the center of the figure eight path of the satellite. It is at this point in the orbit that the polarization of the satellite is rotated to a maximum, equal in magnitude to the inclination, and the rotation of the tracker matches that of the satellite. Twelve hours later, the cone arm 66 will be on the opposite side of the drive circle, again pointing to the center of the figure eight path. The polarizations of both the satellite and tracker are equal in magnitude but opposite in direction.

The tracker assembly contains only three moving parts, i.e., the motor and sidereal gears, the large gear reducer and the CVJ. The motor and gears are standard synchronous equipment used for applications such as wall clocks. The motor operates at one revolution per minute, the rate of a clock sweep second hand. In order to convert this to one revolution per sidereal day, the rate of motion of the satellite, the gear reducers slow the motion by a ratio of 1436.068. This ratio is chosen to match the rate of the sidereal day slightly shorter than the regular day. This reduction also reduces the torque presented to the motor by the weight and wind loading. As a result, the operating torque of the motor is well below its rated value, even at operating wind conditions of 45 mph gusting to 60 mph.

The other two major components, the gear reducer and the CVJ, are designed for high torque, high speed power transmission. Their predicted operating lifetimes for the slow speed operation in the present invention are in excess of one million hours.

AC power may be supplied to the tracker over existing coaxial cable. A small isolation box provided at each end of the coaxial cable will permit 24 volt AC power to be carried on the coax without disturbing the existing transmission of DC LNB power and 950–1450 MHz IF signals. At the IRD end, a small 24 volt signal transformer can be utilized as the power source, permitting low cost code-compliant wiring for a simple installation.

The reliability of the incoming AC power is of significant importance to the overall reliability of the tracking system. Accordingly, a small uninterruptable power supply (UPS) can be provided in order to maintain the tracker correctly faced with the satellite in the event of loss of power. The UPS may be of a size typically used to protect personal computers from AC power outage. A deep discharge battery may be included to keep the tracker running more than three hours of power outage.

A further significant feature of the present invention is that it may be easily retrofitted to existing installations. From a comparison of FIG. 1 with each of FIGS. 2 and 4, it can be seen that the installation of the first embodiment merely requires substituting an electric motor, reduction gearbox and rotating cam for the clamping mechanism 20 in FIG. 1, and that installation of the second embodiment involves simply separating the antenna of FIG. 1 from its mount at the pivot points 14 and 16, and then connecting the tracker assembly 50 to the pivot points 14 and 16 and to the antenna hub.

It will be appreciated that various changes and modifications may be made to the invention disclosed above without departing from the spirit and scope of the invention as defined in the appended claims. By way of example only, the embodiment of FIG. 5 need not use a constant velocity joint, but may instead use any other suitable coupling.

What is claimed is:

1. An apparatus for tracking satellite motion at an antenna, said antenna having a pointing axis with associated hour angle and declination, said apparatus comprising:

oscillation means for automatically imparting a periodic oscillation to the hour angle and the declination of said antenna.

2. An apparatus as defined in claim 1, wherein said oscillation means also imparts a periodic oscillation to said antenna about the pointing axis.

3. An apparatus as defined in claim 1, wherein the oscillation imparted to said declination of said antenna has a period of one sidereal day.

4. An apparatus as defined in claim 1, wherein the magnitude of said oscillation in the declination of said antenna corresponds to the oscillation in the declination of a satellite, as seen from the location of said antenna, due to inclination of the orbit of said satellite relative to the equator.

5. An apparatus as defined in claim 1, wherein said antenna is supported on a support frame, and wherein said oscillation means comprises a base member mounted to said support frame and adjustable to a desired declination, a rotating frame member rotatably mounted to said support frame for rotation about a nominal pointing axis of said antenna, conically rotating means mounted on said rotating frame member for rotating through a conical path, and coupling means for coupling said antenna to said conically rotating means.

6. An apparatus as defined in claim 1, wherein said oscillation means comprises first means rotatable about a first axis, second means having one end rotatable mounted to said first means at a point off center of said first axis, support means for supporting said second means such that said second means moves about a substantially fixed point during rotation of said first means, and third means mounted to said second means and coupled to said antenna.

7. An apparatus as defined in claim 1, wherein said oscillation means includes only a single source of driving power for imparting said periodic oscillation.

* * * * *